US009145637B2

(12) United States Patent
Bae et al.

(10) Patent No.: US 9,145,637 B2
(45) Date of Patent: Sep. 29, 2015

(54) LAUNDRY TREATING APPARATUS WITH LIQUID SPRAYING FUNCTION

(75) Inventors: Sang-Hun Bae, Geumcheon-Gu (KR); Sung-Ho Song, Geumcheon-Gu (KR); Min-Ji Kim, Geumcheon-Gu (KR); Yong-Cheol Jin, Geumcheon-Gu (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/203,391

(22) PCT Filed: Apr. 16, 2010

(86) PCT No.: PCT/KR2010/002380
§ 371 (c)(1),
(2), (4) Date: Aug. 25, 2011

(87) PCT Pub. No.: WO2010/120147
PCT Pub. Date: Oct. 21, 2010

(65) Prior Publication Data

US 2012/0017457 A1 Jan. 26, 2012

(30) Foreign Application Priority Data

Apr. 16, 2009 (KR) ..... 10-2009-0033335
Apr. 16, 2009 (KR) ..... 10-2009-0033336
Apr. 16, 2009 (KR) ..... 10-2009-0033337
Apr. 16, 2009 (KR) ..... 10-2009-0033338

(51) Int. Cl.
*D06F 58/20* (2006.01)

(52) U.S. Cl.
CPC ..... *D06F 58/203* (2013.01)

(58) Field of Classification Search
CPC ..... D06F 58/203; D06F 33/02; D06F 39/005; D06F 2214/00; D06F 58/20
USPC ..... 34/90, 88, 89, 389, 390, 329, 337, 348, 34/357, 486, 342; 68/5 R, 5 C, 12.18; 8/142
See application file for complete search history.

(56) References Cited

U.S. PATENT DOCUMENTS 2,807,893 A 10/1957 Morey
4,236,320 A * 12/1980 Schwadike et al. ..... 34/60
(Continued)

FOREIGN PATENT DOCUMENTS

CN 1656278 A 8/2005
CN 1888206 A 1/2007
(Continued)

*Primary Examiner* — Kenneth Rinehart
*Assistant Examiner* — Tavia Sullens
(74) *Attorney, Agent, or Firm* — Dentons US LLP

(57) ABSTRACT

The present invention relates to a dryer having a liquid spraying function, and according to one aspect of the present invention, a laundry treating apparatus including a plurality of laundry treating courses which have different laundry treating methods is provided. The apparatus comprises: a drum for receiving the laundry; a hot air supply means for supplying hot air to the inner side of the drum; a spraying means for spraying a fragrant solution to the inside of the drum; a manipulating means including a course selecting means for selecting the laundry treating courses; and a controller for controlling the apparatus according to the instructions inputted by the manipulating means, wherein a plurality of laundry treating courses includes at least one scent spray course for spraying the fragrant solution during the laundry treating process, and the course selecting means comprises a scent spray course selecting means for selecting one of the scent spray courses.

6 Claims, 11 Drawing Sheets

(56) References Cited

U.S. PATENT DOCUMENTS

| | | | | |
|---|---|---|---|---|
| 4,642,908 | A * | 2/1987 | Brenner | 34/60 |
| 7,950,088 | B2 * | 5/2011 | Dalton et al. | 68/17 R |
| 2005/0092035 | A1 | 5/2005 | Shin et al. | |
| 2006/0175426 | A1 * | 8/2006 | Schramm et al. | 239/69 |
| 2007/0151129 | A1 * | 7/2007 | McAllister et al. | 38/3 |
| 2008/0115292 | A1 * | 5/2008 | Park et al. | 68/5 C |
| 2009/0272004 | A1 * | 11/2009 | Chernetski et al. | 34/389 |

FOREIGN PATENT DOCUMENTS

| | | | |
|---|---|---|---|
| CN | 101377043 | A | 3/2009 |
| CN | 101377044 | A | 3/2009 |
| EP | 1847643 | A2 | 10/2007 |
| EP | 1852540 | A1 | 11/2007 |
| EP | 1852542 | A1 | 11/2007 |
| JP | 51137960 | A | 11/1976 |
| JP | 7-68094 | A | 3/1995 |
| JP | 2005-095226 | A | 4/2005 |
| KR | 10-2006-0008458 | A | 1/2006 |
| KR | 10-2008-0107766 | A | 12/2008 |
| KR | 10-2009-0004065 | A | 1/2009 |
| KR | 10-2009-0008417 | A | 1/2009 |
| WO | WO/0025132 | * | 5/2000 |
| WO | 2008/016262 | A2 | 2/2008 |
| WO | 2008/072876 | A1 | 6/2008 |
| WO | 2009/008560 | A1 | 1/2009 |

* cited by examiner

LAUNDRY TREATING APPARATUS WITH LIQUID SPRAYING FUNCTION

This application is a National Stage Entry of International Application No. PCT/KR2010/002380, filed Apr. 16, 2010, and claims the benefit of Korean Patent Application Nos. 10-2009-0033335, 10-2009-0033336, 10-2009-0033337, and 10-2009-0033338, all filed on Apr. 16, 2009, all of the applications are hereby incorporated by reference for all purposes as if fully set forth herein.

TECHNICAL FIELD

The present invention relates to a dryer having a liquid spaying function, and more particularly, to a laundry treating apparatus having a liquid spraying function for performing functions such as adding scent, and the like in addition to drying clothes.

BACKGROUND ART

A laundry treating apparatus such as a general dryer or washer having a drying function may include a drum rotatably provided inside a body thereof and a hot air supply means provided inside the drum to supply a hot air at high temperature, thereby performing the function of supplying the hot air at high temperature into the drum in a state that clothes are put into the drum by a user to evaporate moisture included in the clothes.

In recent years, a laundry treating apparatus having various additional functions such as de-wrinkling, softening, de-odor, de-static and scent addition to clothes subsequent to the completion of drying as well as drying clothes has received a positive reaction from the market. Such additional functions are implemented by spraying steam or liquid such as a fragrant solution and the like into the drum during the drying process. For this purpose, the laundry treating apparatus may include a storage tank for storing such liquid and a spraying means for spraying the liquid stored in the storage tank into the drum.

Through this, steam may be sprayed to perform de-wrinkling, de-odor, static electricity prevention, and softening functions, and a fragrant solution may be sprayed to add a desired scent.

On the other hand, such additional functions may be carried out by selecting a preset course or selecting only a specific function through the user, and all the user's intentions may be entered by manipulation buttons provided on a manipulation panel of the laundry treating apparatus.

FIG. 1 is a view illustrating an example of a manipulation panel in the related art. Though the manipulation panel illustrated in FIG. 1 does not include any means for manipulating the foregoing additional functions, it is seen that a plurality of manipulation buttons are provided thereon. More specifically, the manipulation panel may include a power button 10, a course selection button 12 for selecting each preset course, an operation/pause button 14 for initiating or pausing the operation of each course, a dry level button 16 for selecting the level of drying, a temperature control button 18 for indicating the temperature of hot air supplied at the time of drying, a dry time set button 20 for selecting a dry time, a beep sound set button 22 for setting the volume of a beep sound, an option selection button 24 for setting various selection items, and the like.

Some of the buttons may be selectable according to its selected course but some of them may be non-selectable, and thus the user should be familiar with each of the operational relations. According to circumstances, unselectable buttons may be effectuated to invalidate its previous selection or generate a malfunction of the machine.

When a means for manipulating the foregoing additional functions is added in this situation, manipulation convenience may be decreased due to the use of a lot of buttons, and A/S requests may occur very frequently due to simply unskilled manipulation.

Moreover, though the foregoing additional functions may perform various functions according to their combinations, only whether to spray steam or fragrant solution may be simply selected in the related art, and thus a means for more actively utilizing the additional functions is required.

DISCLOSURE OF THE INVENTION

The present invention is contrived to overcome the disadvantages of the related art, and a technical task of the present invention is to provide a laundry treating apparatus having a manipulating means for more effectively and easily manipulating various functions of the laundry treating apparatus having a liquid spraying function.

In order to accomplish the foregoing technical task, according to an aspect of the present invention, there is provided a laundry treating apparatus having a plurality of laundry treating courses with different laundry treating methods, and the apparatus may include a drum configured to accommodate the laundry; a hot air supply means configured to supply hot air to an inner side of the drum; a spraying means configured to spray a fragrant solution into an inner portion of the drum; a manipulating means comprising a course selection means configured to select the laundry treating courses, and a controller configured to control the apparatus according to an instruction inputted by the manipulating means, wherein the plurality of laundry treating courses comprises at least one scent spray course for spraying the fragrant solution during the laundry treating process, and the course selection means comprises a scent spray course selection means for selecting one of the scent spray courses.

In the above aspect of the present invention, a scent spray course may be carried out by providing a scent spray course other than a separate selection button, as well as not allowing the user to select a drying course and then manipulate the scent spraying manipulating means but allowing the user only to select the scent spray course, thereby easily manipulating a scent spraying function.

Here, the laundry treating apparatus may include a plurality of scent spray courses with different scent spray timings during the laundry treating process.

Furthermore, wherein the manipulating means may further include a scent strength adjustment means, and the controller may control such that the scent strength is adjusted according to a scent strength selected by the scent strength adjustment means.

On the other hand, the manipulating means may further include a scent spraying cancellation means, and the controller may control such that a fragrant solution spraying process is not carried out while performing a laundry treating course selected by the course selection means when the scent spraying cancellation means is selected. Through this, when a scent spraying process is included in the selected course, the user may selectively cancel the scent spraying.

Here, the scent strength adjustment means and scent spraying cancellation means may be configured with push buttons, and they are configured with individual buttons, respectively, or may be configured with one push button.

Here, the scent strength adjustment means may be deactivated when a course selected by the course selection means does not include a scent spraying process. Deactivation denotes a state in which it is not manipulated even when the user attempts to manipulate through a control means. Furthermore, the scent spraying cancellation means may be also deactivated when a course selected by the course selection means does not include a scent spraying process.

In this case, when the scent strength adjustment means and scent spraying cancellation means are deactivated, a display means capable of visually and auditorily displaying them may be additionally provided in the manipulating means, thereby allowing the user to check in advance whether or not manipulation through the relevant means is enabled.

Furthermore, a scent spray course selection means of the course selection means may further include a recognition means allowed to be visually distinguished from the remaining course selection means. Through this, it may be possible to guide the user's correct course selection.

Here, the recognition means may include a light-emitting means disposed around or at a bottom surface of the course selection means.

According to another aspect of the present invention, there is provided a laundry treating apparatus having a plurality of laundry treating courses with different laundry treating methods, and the apparatus may include a drum configured to accommodate the laundry; a plurality of storage containers configured to store a fragrant solution and water, respectively, to be sprayed to the laundry accommodated inside the drum; a spraying means configured to selectively spray a fragrant solution or water into an inner portion of the drum; a manipulating means comprising a course selection means configured to select the laundry treating courses and a medium selection means configured to set a kind of liquid to be sprayed, and a controller configured to control the apparatus according to an instruction inputted by the manipulating means, wherein the plurality of laundry treating courses comprises a plurality of liquid spray courses for spraying at least one of the fragrant solution and water during the laundry treating process, and the course selection means comprises a liquid spray course selection means for selecting one of the liquid spray courses.

In the above aspect of the present invention, the laundry treating apparatus may include a plurality of liquid spray courses for spraying various liquids such as water or a fragrant solution during the drying process to be selected by a course selection means, respectively, thereby allowing the user to spray a desired liquid using only a course selection means without manipulating a separate manipulating means.

Here, a liquid spray course selection means for selecting a course that sprays non-selected liquid may be deactivated when a kind of liquid to be sprayed is selected by the medium selection means.

Moreover, the manipulating means may further include a scent strength adjustment means and a scent spraying cancellation means as described above. In this case, the scent strength adjustment means may be deactivated when a course selected by the course selection means does not include a scent spraying process or water is selected by the medium selection means. Furthermore, the scent spraying cancellation means may be also deactivated when a course selected by the course selection means does not include a scent spraying process or water is selected by the medium selection means.

In order to allow the user to easily recognize such a deactivated state, when the scent strength adjustment means is deactivated, a display means capable of visually and auditorily displaying it may be additionally provided in the manipulating means.

Furthermore, a scent spray course selection means of the liquid spray course selection means may further include a recognition means allowed to be visually distinguished from the remaining course selection means. Here, at least one course selection means may be disposed between the fragrant solution spray course selection means and water spray course selection means of the liquid spray course selection means, thereby preventing a mal-manipulation from being generated when the fragrant solution spray course selection means and water spray course selection means are adjacent to each other.

According to still another aspect of the present invention, there is provided a laundry treating apparatus having a plurality of laundry treating courses with different laundry treating methods, and the apparatus may include a drum configured to accommodate the laundry; a hot air supply means configured to supply hot air to an inner side of the drum; a storage container configured to store a liquid to be sprayed to the laundry accommodated inside the drum; a spraying means configured to spray the liquid stored in the storage container into an inner portion of the drum; a medium recognition means configured to recognize a kind of the liquid stored in the storage container; a manipulating means comprising a course selection means configured to select the laundry treating courses, and a controller configured to control the apparatus according to an instruction inputted by the manipulating means, wherein the plurality of laundry treating courses comprises a plurality of liquid spray courses for spraying the liquid during the laundry treating process, and the course selection means comprises a liquid spray course selection means for selecting one of the liquid spray courses, and the controller recognizes a kind of liquid stored in a storage container by the medium recognition means, and deactivates a course selection means corresponding to a course for spraying a liquid different from the liquid stored in the storage container among the liquid spray course selection means.

According to the above aspect of the present invention, a kind of liquid stored in the storage container may be recognized to deactivate some of the courses based on the result, thereby allowing the user to prevent a mal-manipulation.

Here, the medium recognition means may include an electrode sensor having a pair of electrodes being brought into contact with the liquid, and a level of voltage drop varied for a kind of liquid can be measured through the electrode sensor, thereby allowing the user to distinguish the kind of liquid.

On the other hand, when some of the liquid spray course selection means are deactivated, a display means capable of visually and auditorily displaying them may be additionally provided in the manipulating means.

Moreover, the manipulating means may further include the foregoing scent strength adjustment means and a scent spraying cancellation means. Here, the scent strength adjustment means may be deactivated when a course selected by the course selection means does not include a scent spraying process or water is stored in the storage container. Furthermore, the scent spraying cancellation means may be also deactivated when a course selected by the course selection means does not include a scent spraying process or water is stored in the storage container.

Furthermore, a scent spray course selection means of the liquid spray course selection means may further include a recognition means allowed to be visually distinguished from the remaining course selection means, and at least one course selection means may be disposed between the fragrant solution spray course selection means and water spray course selection means of the liquid spray course selection means.

According to aspects of the present invention having the foregoing configuration, scent spraying may be adjusted to the user's desired level by a course selection means, thereby drastically enhancing manipulation convenience.

Furthermore, a means capable of selecting an additional function associated with liquid spraying may be provided and thus various functional controls are allowed for each person, and such means may be activated only when it is selectable, thereby preventing a mal-manipulation or unnecessary manipulation.

MODES FOR CARRYING OUT THE PREFERRED EMBODIMENTS

Hereinafter, preferred embodiments of a laundry treating apparatus having a liquid spraying function and an operation method thereof according to the present invention will be described in detail with reference to the accompanying drawings.

Figure 2:
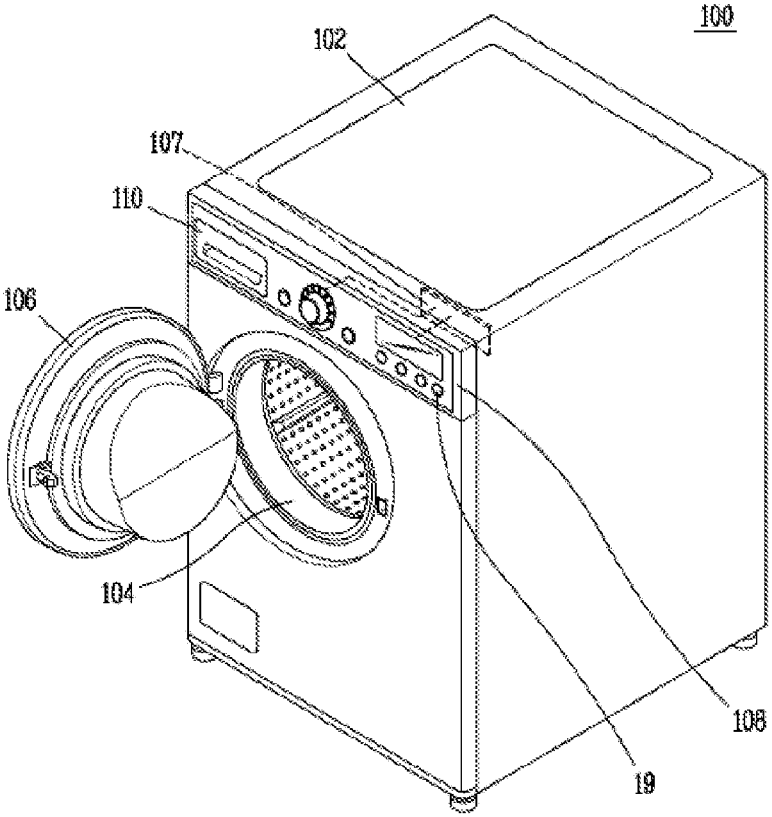
FIG. 2 is a perspective view illustrating an embodiment of a laundry treating apparatus according to the present invention.
Figure 3:
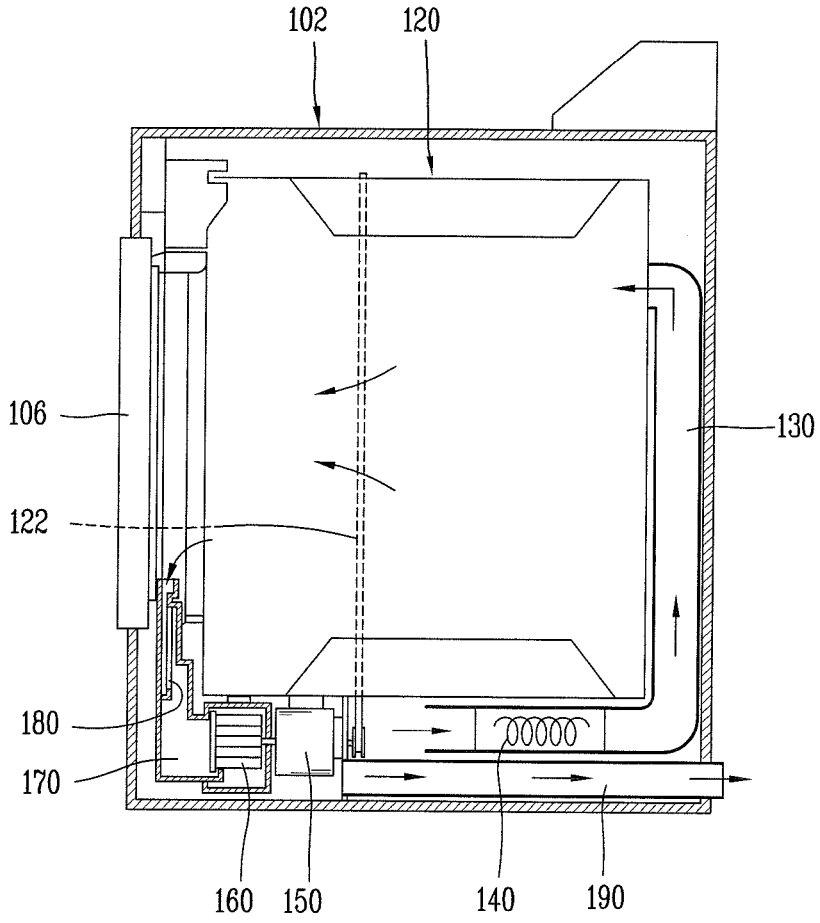
FIG. 3 is a cross-sectional view schematically illustrating the embodiment illustrated in FIG. 2.
Figure 4:
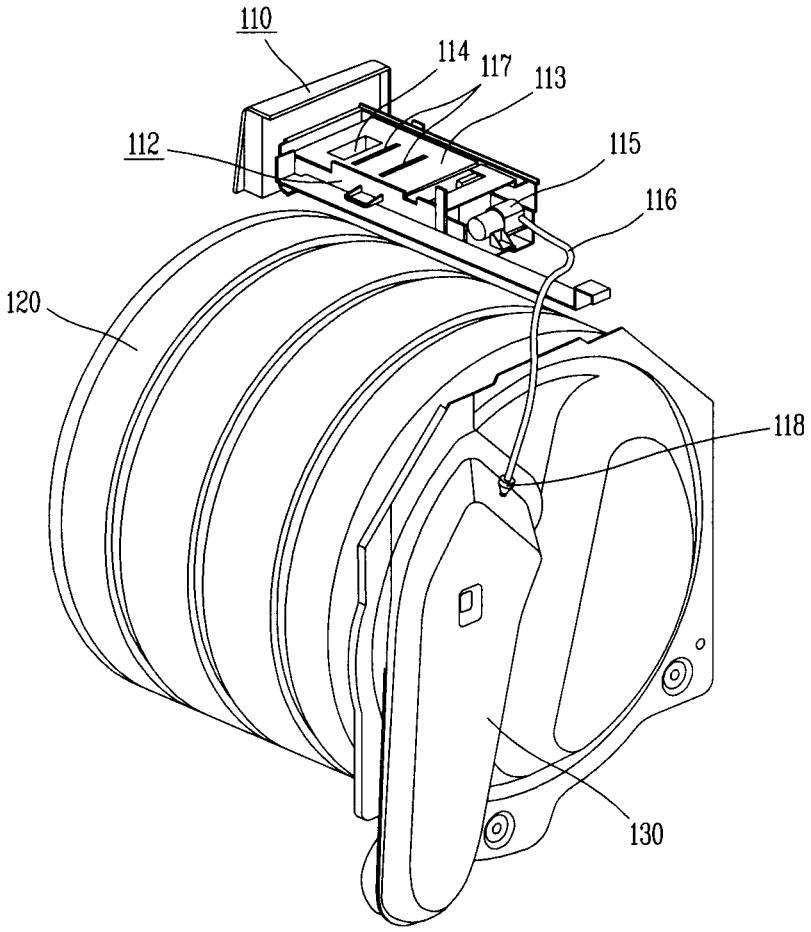
FIG. 4 is a perspective view schematically illustrating the embodiment illustrated in FIG. 2.

FIG. 2 is a perspective view schematically illustrating an embodiment of a laundry treating apparatus having a liquid spraying function according to the present invention. FIG. 3 is a cross-sectional view schematically illustrating an internal structure of the embodiment illustrated in FIG. 2. FIG. 4 is a perspective view schematically illustrating an internal structure of the embodiment illustrated in FIG. 2. The embodiment illustrated in FIG. 2 is an example applied to a dryer. Referring to FIG. 2, the dryer 100 may include a body 102 constituting an external appearance of the apparatus, and an inlet port 104 for putting clothes, which are drying objects, into the body 102 may be formed at a front surface of the body 102. The inlet port 104 may be opened and closed by a door 106, and a manipulation panel 108 on which various manipulation buttons for manipulating the dryer are disposed may be located at an upper side of the inlet port 104. The manipulation panel 108 comprises a scent spraying cancellation button 19. Of course, the present invention will not be necessarily limited to the dryer, and also may be applicable to any laundry treating apparatus having a drying function, for example, a washer having a drying function, and the like.

On the other hand, a drawer cover 110 may be provided at a side of the manipulation panel 108, and a cartridge, which will be described later, may be mounted at an inner side of the drawer cover 110. A liquid, particularly a fragrant solution, to be sprayed to the drum thereinside may be stored in the cartridge, and the fragrant solution may be a mixture in which water and a crude fragrant solution are mixed at a predetermined ratio.

A dryer which is a laundry treating apparatus of the present invention may be provided with a drum 120 rotatably installed inside the body 102 to dry drying objects thereinside, and the drum 120 may be rotatably supported by a supporter at the front and rear sides thereof. Furthermore, the drum 120 may be connected to a drive motor 150 provided at a bottom portion of the dryer through a power transmission belt 122 to receive rotational force. Furthermore, a suction duct 130 may be provided at a rear side of the drum 120, and a heater 140 for heating inhaled air is provided at an inlet portion of the suction duct 130. Furthermore, a filter 180 for filtering out foreign substances such as lint or the like contained in air exhausted from the drum 120 is provided, and ducts 170, 190 for filtering out foreign substances and then completely exhausting the air out of the dryer may be provided at a lower front side of the drum 120.

A ventilation fan 160 for inhaling air inside the drum 120 and forcibly ventilating the air out of the dryer may be provided at the ducts 170, 190. In other words, an end portion of the duct 190 may be communicated with the outside of the body 102 to perform a role of guiding the air forcibly ventilated by the ventilation fan 160 out of the dryer. The ventilation fan 160 illustrated in this embodiment may be a full type ventilation fan existing on a duct for exhausting air from the drum to inhale the air being discharged from the drum to a side of the exhaust duct. However, according to the configuration of the dryer, it may also have a type in which a ventilation fan is located inside the suction duct 130 for supplying hot air to the drum to push the heated air inside the suction duct to the drum, which is called a push type.

A power transmission belt 122 for driving the drum may be connected to a pulley formed at a side of the drive motor 150, and a driving shaft of the ventilation fan may be connected to the other side of the drive motor 150 to drive the ventilation fan 160. Therefore, in this embodiment, if the drive motor 150 is rotated, then the drum and ventilation fan will be rotated at the same time. A system for driving the drum and ventilation fan at the same time using a motor may be called a one-motor system.

However, an example in which a drum drive motor for rotating the drum 120 and a fan motor for rotating the ventilation fan 160 are formed with separate motors, respectively, to have two motors may be also taken into consideration.

FIG. 4 is a simplified perspective view illustrating a scent supply module in a type in which a drum and a cartridge inside the dryer are inserted into a drawer. Referring to this, a drawer 112 may be mounted at a rear surface of the drawer cover 110, and the drawer 112 may be moved in a taking in-and-out manner together with the drawer cover 110, and a cartridge 113 may be accommodated at an inner side thereof. The cartridge 113 may be a vacant inside container to store a fragrant solution injected through an injection hole 114 formed at an upper surface thereof. On the other hand, the cartridge 113 may be combined with a spraying pump 115 through a check valve (not shown) or the like, and thus a liquid stored in the cartridge 113 may be moved along a connection hose 116 while being sprayed by the pump 115 at a high pressure. Furthermore, the connection hose 116 may be connected to a nozzle 118 provided at an upper portion of the suction duct 130 fixed to a rear surface supporter for rotatably supporting the drum 120. Through this, a fragrant solution stored in the cartridge 113 may be sprayed in an atomized state to an inner side of the drum 120 through the suction duct 130. In this embodiment, though an example of providing the nozzle in the suction duct 130 is taken into consideration, it may not be necessarily limited to this, the nozzle 118 may be provided at a rear surface of the drum to spray a fragrant solution directly to the inside of the drum.

An electrode sensor 117 for recognizing a kind of liquid stored in the cartridge may be provided at an inner portion of the cartridge 113 or in the connection hose 116. The electrode sensor may include a pair of electrodes to measure a level of voltage drop due to a resistance of liquid between the electrodes, thereby allowing the user to distinguish a kind of liquid.

On the other hand, referring to FIG. 4, only one cartridge can be mounted on the dryer at the same time, and thus the user should exchange the cartridge to selectively spray a fragrant solution or water. However, an example of mounting two cartridges at the same time may be taken into consideration, and water and a fragrant solution may be stored each cartridge, respectively.

The fragrant solution may vary its spray timing and spray amount based on each drying course. The drying course provided in the dryer may be largely classified into a general drying course for drying wet clothes having a typical meaning and a fragrant solution spray course for enhancing the state of non-wet clothes.

The general drying course may include a hot air supply step in which hot air at high temperature is supplied to an inner portion of the drum to perform drying and a fragrant solution spray step in which the fragrant solution is sprayed to an inner portion of the drum in a state that drying is completed to suspend the supply of hot air, thereby drying wet clothes as well as adding scent. Here, a time for supplying hot air in the hot air supply step should be varied based on a kind of cloth, and thus the general drying course may include a plurality of courses based on each cloth. In case of the general drying course, the step of spraying a fragrant solution subsequent to the completion of drying may be selectively carried out by the user. In other words, a fragrant solution may be sprayed only at the user's desired timing, and for this purpose, a means capable of determining whether to spray a fragrant solution and selecting a scent strength may be provided at the manipulation panel. It will be described later.

The fragrant solution spray course may be a course for adding a function of enhancing the state of clothes in addition to a drying function to perform functions such as de-odor, de-wrinkling, de-static, softening, and the like in addition to scent addition. More specifically, the fragrant solution spray course may include a scent addition course for performing de-odor, de-static, and softening operations by supplying hot air for a relatively short period of time, for example, 5-10 minutes, compared to the general drying course, and then spraying a fragrant solution to add scent. At this time, the fragrant solution may be sprayed in an amount of about 10 cc for 10 seconds subsequent to the completion of drying, and hot air supplied prior to spraying the fragrant solution may soften clothes and increase the surface temperature of clothes, thereby allowing scent to be more efficiently coated on clothes. Furthermore, a foul odor soaked into clothes may be exhausted due to hot air, thereby effectively removing the odor.

Furthermore, the fragrant solution spray course may include a scent refresh course for spraying the fragrant solution while supplying hot air for 15-20 minutes and then respraying the fragrant solution prior to cooling subsequent to supplying hot air. The fragrant solution sprayed while supplying hot air may be sprayed in an amount of about 30 cc for one minute after 4 minutes has passed subsequent to the start of supplying hot air. The moisture containing the sprayed fragrant solution may be evaporated by the hot air and the evaporated steam may be brought into contact with clothes to remove the wrinkle, odor and static of clothes and soften clothes by preventing clothes from being excessively dried. During the process, a scent component together with hot air may be exhausted out of the drum and then diluted by continuously supplied hot air and thus scent may not be added to clothes. Subsequent to the completion of supplying hot air, about 10 cc of the fragrant solution may be sprayed again for 10 seconds to add scent to clothes.

Furthermore, the fragrant solution spray course may include a refresh course for spraying the fragrant solution only while supplying hot air for 15-20 minutes. The refresh course may spray a fragrant solution only while supplying hot air, thereby removing only the scent addition function from the scent refresh course. However, during the refresh course, an amount of fragrant solution being sprayed may be set to about 50 cc, which is greater than that of the scent refresh course, to enhance the effect due to steam supply.

On the other hand, the refresh course may be applicable even when water is stored in the cartridge. In other words, water may be sprayed into an inner portion of the drum during the drying process to perform the foregoing de-wrinkling, de-static and softening operations. Accordingly, when only one cartridge is mounted thereon, a fragrant solution or water may be sprayed based on a kind of liquid stored in the cartridge to perform the refresh course. When two cartridges are mounted thereon, water may be sprayed to perform the refresh course. Here, considering that the fragrant solution is relatively expensive than water, in case where a fragrant solution is stored in the cartridge when only one cartridge is mounted thereon, the refresh course may not be carried out or a beep sound may be generated to notify the user to replace it by a cartridge stored with water.

Here, the scent spray will be described in detail.

The scent spray method may be largely divided into (1) a pre-processing step, (2) a scent-processing step, and (3) a post-processing step.

Hereinafter, it will be briefly described.

(1) The pre-processing step is a process for raising and freshening clothes to allow scent to be well soaked into the clothes. Supplying scent to the drum in a dryer according to the present invention relates to spraying scent subsequent to drying the laundry for which washing and dehydration have completed in the dryer, but will not be necessarily limited to this, and the scent supply process according to the present invention may be carried out before the user takes a cloth that has been stored for a long period of time out of a closet to use the cloth. The clothes that have been stored in a closet for a long period of time may be crumpled and wrinkled during the storage or the odor of the closet may be soaked therein, and thus a process for supplying scent may be provided to remove the odor. Furthermore, if clothes are subjected to the pre-processing step prior to supplying scent, then the clothes may be raised, thereby allowing scent to be well deposited in the following scent-processing step.

(2) The scent-processing step is a process of pumping a fragrant solution stored in the foregoing scent supply module and spraying it into the drum through a nozzle, thereby allowing scent to be soaked into the clothes. In the foregoing scent supply module, it is illustrated an example in which a fragrant solution is pressurized at a predetermined pressure using a pump in a storage tank or chamber and then sprayed into the drum through the nozzle. However, according to the embodiments, a supply passage for supplying scent may be opened without pumping a fragrant solution to the pump to supply scent to an inner portion of the drum, or a separate evaporation unit may be configured to evaporate a fragrant solution and supply scent to an inner portion of the drum in order to accelerate the evaporation of scent. In this case, the evaporation unit may be provided at various locations such as a front supporter, a rear supporter, or an inner portion of the duct to which scent is induced.

(3) The post-processing step may be implemented to uniformly distribute scent sprayed to the drum over the clothes, and uniformly dry the clothes, and the post-processing step may include a cooling process, a drying process, and a recooling process. The cooling process is provided to easily transfer scent sprayed to an inner portion of the drum between clothes, and the drying process may be provided to dry the scent sprayed to the drum, and the recooling process is provided to reduce the temperature of the inner portion of the drum, allowing the user to take out the clothes at last. However, cooling may not be provided at the time of initially spraying scent during the refresh cycle, and it will be described below.

Hereinafter, (1) the pre-processing step, (2) the scent-processing step, and (3) the post-processing step will be described in detail.

(1) Pre-Processing Step

The fundamental method of the pre-processing step is first to tumble the drum (rotate the drum at a predetermined speed by a driving means), and the tumble may be carried out in a unidirectional or bidirectional manner. The clothes accommodated in the drum by the tumble may be subjected to a rising-and-falling process while being rotated together with the drum, and the clothes may be raised and foreign substances that can be attached to the clothes may be dusted and removed to be in a freshened state.

Furthermore, the time for performing the tumble during the pre-processing step may be preferably longer than the time consumed in the scent-processing step, and the suitable tumble time may be about 4 to 5 minutes according to the experiment.

Furthermore, air may be supplied to the drum during the tumble, which is implemented by operating a ventilation fan provided in the dryer. If air is circulated by a ventilation fan to the drum during the tumble process, then foul odor remained between clothes can be removed, and the permeation of scent materials may be further facilitated while passing air through the clothes.

Furthermore, in this case, the air supplied to the drum may be hot air heated by the heater, and in case of supplying hot air, the structure of the clothes may be further softened, thereby further enhancing a freshening effect. In case of supplying hot air, a process of reducing the temperature inside the drum may be necessarily required immediately prior to entering the scent-processing step because when scent is sprayed to the clothes in a state that the temperature inside the drum or the temperature of the clothes is high, because the scent is not deposited but immediately evaporated, thereby reducing the strength of the scent deposited on the clothes.

As described above, the temperature inside the drum should be recognized in the step of spraying scent, and at this time the temperature may be based on a temperature measured at a specific point inside the drum or measured at the clothes tumbled in the drum, or may be based on a temperature of the air discharged from the dryer drum.

Though the strength of the scent deposited on the clothes taken from the drum is subjectively felt by the user, it was obtained that the stronger the level of the scent strength felt by the user, the lower the temperature inside the drum according to the experiment. In a typical drying process of the dryer, the process of reducing the temperature of the laundry through a cooling process for supplying non-heated air may be carried out prior to taking out the laundry from the drum subsequent to the completion of drying, and thus the consumer who takes out the laundry does not feel hot. Furthermore, considering the temperature of the clothes taken out by the user based on the temperature of the drum outlet port, it was found that the strength of the scent felt by the consumer at about 47 degrees is far weaker than that of the scent felt by the consumer at about 30 degrees.

Figure 5:
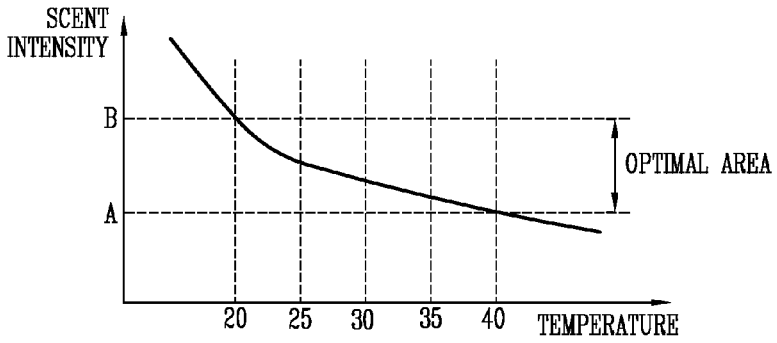
FIG. 5 is a graph illustrating a change of scent strength based on temperature.

Referring to FIG. 5, the above description is illustrated in a graph. The horizontal axis of the graph represents a temperature of the drum at the timing of spraying scent to the drum, and the vertical axis thereof represents a size of the strength of the scent. In this embodiment, the above temperature was measured based on the temperature of the drum outlet port. However, it is not necessarily limited to this, and the temperature of the drum may be measured at another portion inside the drum, and may be illustrated in a graph by comparing the temperature measured at another portion of the drum with the strength of the scent at the time. However, in case of measuring the temperature at another portion of the drum, it may be slightly different from the graph of FIG. 5 in the aspect of specific values, but a broad shape of the graph will be the same.

According to this embodiment, as illustrated in FIG. 5, it was found that the user feels scent from the clothes when the temperature at the timing of spraying scent to the drum is under about 40 degrees, but the strength of the scent may be excessively strong at temperatures under 20 degrees so as to cause a negative feeling to the user. Accordingly, the optimal temperature for processing scent may be located between about 40 and 20 degrees. Here, the user wants to process clothes within a short period of time, and thus when it is taken into consideration it may be controlled to have a suitable strength of the scent within a proper time when the temperature inside the drum is located between about 35 and 25 degrees. Most preferably, it may be possible to obtain an optimal result in the terms of time and scent strength when the temperature of the drum is controlled at about 30 degrees at the timing of spraying scent. Here, the temperature inside the drum is based on the temperature of the drum outlet port, but it may be used as a temperature of the drum by measuring the temperature at another point inside the drum other than the temperature of the outlet port as described above. However, in case of using the temperature at another point of the drum, it may be slightly different from the temperature of the drum outlet port, and there was a difference of about 3 degrees according to the experiment.

The scent strength felt by the user when scent is deposited on clothes may be determined in various ways according to the user's request. A selection button may be provided on a dryer control panel to allow the user to select his or her desired strength, and the dryer controller may control such that an inner portion of the drum has a different temperature in order to control a scent strength corresponding to a button selected by the user. For example, the user may select a course capable of performing a scent-processing operation, and then set his or her desired scent strength through a scent strength adjustment unit capable of selecting the strength of the scent, and when a manipulation button of the dryer is pressed, the controller may detect the strength of the scent selected by the user (for example, high, medium, low) and control the temperature inside the drum according to the selected scent strength. To this end, in case where the strength of the scent strength adjustment unit selected by the user is "high," the controller may read a temperature value of the temperature sensor (here, a temperature sensor of the drum outlet port) and operate a scent spray pump or switching valve for a preset period of time when the temperature of the drum outlet port is 25 degrees to spray or evaporate scent materials into the drum, thereby allowing scent to be soaked into the clothes. In a similar manner, in case where the strength of the scent strength adjustment unit selected by the user is "medium" or "low," the controller may operate a scent spray pump or switching valve for a preset period of time when the temperature of the drum outlet port is 30 or 35 degrees, thereby allowing scent to be soaked into the clothes.

In this case, instead of a temperature value, a cooling time (time for supplying air that is not heated by the heater) corresponding to the scent strength may be set to control the operation. Furthermore, the scent strength may be controlled by varying the spray time of the scent, and it will be described in detail in the following scent-processing step.

(2) Scent-Processing Step

The feature of the scent-processing step is to tumble the drum while spraying scent to an inner portion of the drum from the scent supply module for a specified period of time. Furthermore, a spray amount of the scent being sprayed to an inner portion of the drum may be determined by a mass flow of the sprayed fragrant solution, an operating time of the pump or an opening time of the switching valve, and the spray amount of the scent may be determined according to the strength of the scent selected by the user. In other words, when the strength of the scent strength adjustment unit selected by the user is high, the operating time of the pump or the like is controlled to be long and thus a larger quantity of the scent is sprayed, thereby controlling the spray amount. Hereinafter, several embodiments of the scent-processing step according to the present invention will be described.

1) First Embodiment

In the first embodiment, a continuous spray and an intermittent spray among the method of spraying scent to the drum will be described.

The continuous spray in this embodiment is a case where scent sprayed from the scent supply module to the drum is continuously sprayed, and the intermittent spray is a case where spraying scent to the drum is intermittently carried out by repetitively turning on and off a pump or switching valve of the scent supply module. The continuous spray and intermittent spray can be distinguished by an amount of the laundry, namely, a laundry quantity, put into the drum. The continuous spray may be carried out when the controller of the dryer detects the laundry quantity put into the drum and determines that the laundry quantity is small, and the intermittent spray may be carried out when the controller determines that the laundry quantity is large.

More specifically, the process of processing scent may include a case where the user selects a scent-processing operation and a case where the user selects a general drying operation including the scent spray process. The process of a case where the user selects a scent-processing operation may include selecting a scent-processing operation; allowing the dryer controller to detect a laundry quantity; performing an intermittent spray when the laundry quantity detected in the clothes amount detection step is large; and performing a continuous spray when the laundry quantity detected in the clothes amount detection step is small. In this case, scent may be sprayed to the drum while repetitively turning on and off for a predetermined period of time based on the detected clothes amount.

Furthermore, the process of a case where the user selects a general drying operation including the scent spray process may include selecting a drying operation; allowing the controller to detect a laundry quantity; a drying operation step for drying clothes; and a scent spray step for spraying scent to the drum. In the scent spray step, the intermittent spray may be carried out when the laundry quantity detected by the controller is large, and the continuous spray may be carried out when the laundry quantity detected by the controller is small. In the intermittent spray, scent may be sprayed while repetitively turning on and off for a predetermined period of time based on the detected clothes amount. Furthermore, the time for spraying scent (continuous spray or intermittent spray) may be determined based on the scent strength or clothes amount selected by the user, or determined by taking both into consideration.

In case of a large laundry quantity, scent may be sprayed in an intermittent manner because the sprayed scent can be easily and uniformly deposited on the clothes in case of a small laundry quantity but scent deposition may not be uniformly carried out through the continuous spray in case of a small laundry quantity. Accordingly, in case of a large laundry quantity, scent may be sprayed to the drum from the scent supply module for a predetermined period of time and then the drum may be tumbled to mix the clothes, and the clothes may be disentangled and then resprayed, thereby allowing scent to be effectively deposited on the clothes. Through this process, scent may be uniformly deposited on the clothes to enhance the uniformity of scent.

According to the experiment, preferably, a continuous spray may be carried out in case where the laundry quantity is 1-2 kg, and an intermittent spray may be carried out in case where the laundry quantity is greater than 3 kg. Furthermore, in case of the intermittent spray, the intermittent period, namely, the time for which the pump is turned off, may be preferably a time taken for the clothes to perform a rotational behavior in the drum as rotating the drum (i.e., a time taken for the clothes to rise along the drum and then fall to be disentangled or mixed), and the time may be preferably 5 seconds. Furthermore, the time for which the pump of the scent supply module is turned on during the intermittent spray may be preferably set such that the last on-time is equal to or greater than the previous on-time. For example, the time for which the pump of the scent supply module is turned on during the intermittent spray process when the user selects the strength of the scent with "medium" in case where the laundry quantity is 3 kg may be carried out by turning on 15 seconds, off 5 seconds, on 15 seconds, off 5 seconds, and on 20 seconds.

2) Second Embodiment

In the second embodiment, it is not related to a drying course that is performed subsequent to the washing and dewatering processes, but related to a case where scent is processed for the clothes being used or stored within a short period of time. Hereinafter, it may be called "touch-up process". In this case, the detection of the clothes amount may not be necessarily carried out in a separate manner, and the scent spray may have a continuous spray process.

The touch-up process according to this embodiment may include selecting a touch-up process; a cooling step; and a scent spray step. In this case, the cooling step may be carried out immediately prior to the scent spray step, and scent may be continuously sprayed in the scent spray step.

Furthermore, according to another embodiment of the touch-up process, it may include the step of allowing the user to select the strength of the scent. In this case, the touch-up process may include selecting a touch-up process; selecting the strength of the scent; a cooling step; and a scent spray step. Furthermore, in this case, an amount of spraying scent may be adjusted based on the strength of the scent selected by the user, and the amount of spraying scent may be controlled by the time of operating a pump or valve of the scent supply module.

3) Third Embodiment

The third embodiment is related to a process for spraying scent to clothes inside the drum to remove the wrinkle of the clothes, perform de-odor, or the like. Hereinafter, the process may be called a "refresh process". The process may be carried out for the laundry that has completed the washing and dewatering processes, or may be performed for clothes being used or stored.

The refresh process according to this embodiment may include selecting a refresh process; a first scent spray step; a cooling step; and a second scent spray step. In this case, the scent spray step may be carried out by a continuous spray process for continuously spraying scent. Furthermore, the time for which scent is sprayed in the first scent spray step may be set to be longer than the time for which scent is sprayed in the second scent spray step, thereby removing the wrinkle of the clothes and implementing the de-odor effect by spraying a larger amount of scent compared to the first scent spray step. The refresh process may further include a drying step for supplying hot air to dry clothes between the first scent spray step and the second scent spray step, thereby drying the clothes when the clothes are soaked with the scent sprayed to the drum during the first scent spray step.

Furthermore, according to another embodiment of the refresh process, the strength of the scent may be selected by the user. In this case, the refresh process may include selecting a refresh process; selecting the strength of the scent; a first scent spray step; a cooling step; and a second scent spray step. When the user selects the strength of the scent, scent may be sprayed by adjusting the amount of spraying scent based on the selected strength of the scent. The amount of spraying scent may be controlled by the time of operating a pump or valve of the scent supply module.

In the scent-processing step as described above, a ventilation fan of the dryer may be continuously operated to supply air to an inner portion of the drum while rotating the drum during the process of spraying scent, or the ventilation fan of the dryer may be turned off not to supply air to an inner portion of the drum while rotating the drum during the process of spraying scent.

3) Post-Processing Step

The post-processing step is a process for performing a cooling process that supplies air to the drum by operating a ventilation fan in a state that the heater is turned off. It is provided for a scent component to be transferred and fixed to the clothes without being evaporated from the clothes through the cooling step immediately subsequent to spraying scent.

Furthermore, the post-processing step may further include a drying process to remove moisture that might be remained in the clothes by the scent sprayed and provide comfortableness during the scent spray step. During the drying process, the heater of the dryer may be operated to supply hot air to an inner portion of the drum. Furthermore, the post-processing step may further include a cooling process subsequent to performing the drying process, thereby allowing the user who takes out the clothes not to feel hotness. In this case, the temperature of the cooling process may be higher than that of the cooling process for spraying scent during the scent spray step. If the post-processing step immediately subsequent to spraying scent is carried out too long, then scent may be evaporated out, and thus the post-processing step should be shorter than the pre-processing step prior to the scent spray step.

On the other hand, an amount of fragrant solution being sprayed during each course may be adjusted by the user at his or her discretion. In other words, the user can adjust the strength of the scent by further increasing or decreasing a value set for each course. The selection of the course and adjustment of the scent strength may be carried out through the forgoing manipulation panel 108.

Figure 1:
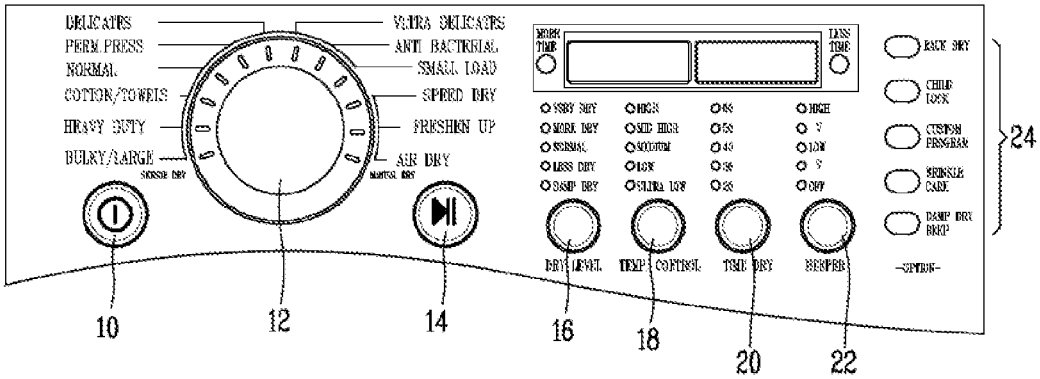
FIG. 1 PRIOR ART
FIG. 1 is a front view illustrating an example of a manipulation panel on a dryer in the related art.
Figure 6:
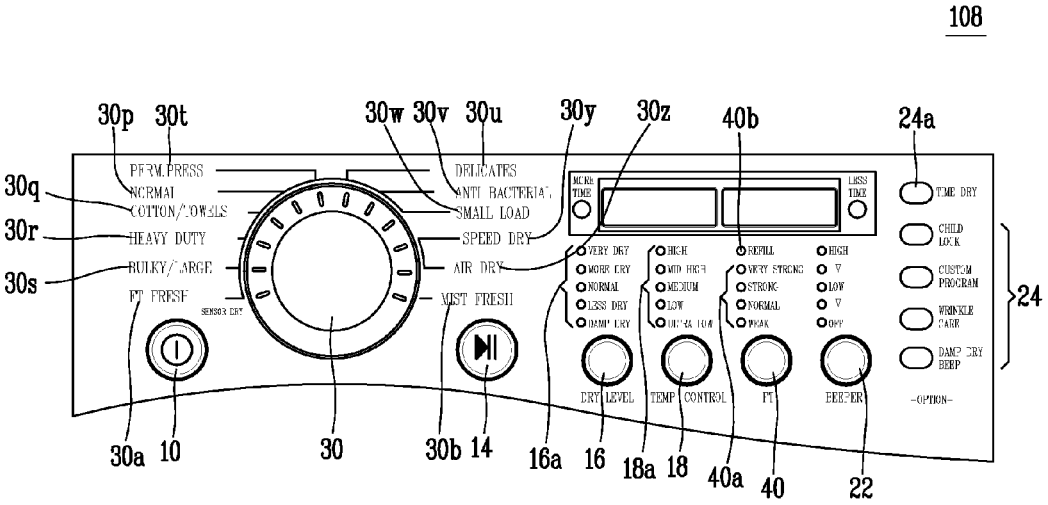
FIG. 6 is a front view illustrating a manipulation panel included in the embodiment.

FIG. 6 is a view illustrating an example of the manipulation panel 108, and a power button 10 is provided at the left side of the manipulation panel 108, and a course selection knob 30 is provided at the right side of the manipulation panel 108. In the following description, the same elements as the buttons illustrated in FIG. 1 are designated with the same numeral references and their redundant description will be omitted.

The items corresponding to each course provided in the dryer may be arranged at an outer circumferential portion of the course selection knob 30, and the course provided therein may be selected by rotating the course selection knob 30 to align one of the items to a display line (not shown) of the knob 30. Here, the item corresponding to reference numeral 30*a* may correspond to a scent refresh course of the foregoing courses, and the item corresponding to reference numeral 30*b* may correspond to a refresh course, and other courses 30*s*, 30*r*, 30*g*, 30*p*, 30*t*, 30*u*, 30*v*, 30*w*, 30*y*, 30*z* may be disposed between the scent refresh course and the refresh course. As a result, they may be disposed at an opposite side to each other around the knob 30, thereby preventing the user's confusion. Accordingly, the user may select either one of the two courses by rotating the knob 30. As described above, in case of the refresh course, a fragrant solution or water may be sprayed only during the hot air supply process, and thus scent may not be added.

On the other hand, an operation/pause button 14 may be provided at the right side of the knob 30, and a dry level button 16, a temperature control button 18 for indicating the temperature of hot air supplied at the time of drying, a beep sound set button 22 for setting the volume of a beep sound to notify various configurations to the user, and an option selection button 24 for setting various selection items, and the like may be provided at the right side thereof. A dry level display button 16*a* for displaying a state of being set may be provided at a portion over the dry level button 16, wherein the dry level display button 16*a* may include a plurality of LED elements, and an element having the corresponding level of the LED elements emits light whenever pressing the dry level button 16. It may be also applicable to the temperature display means 18*a* disposed at an upper portion of the temperature control button 18.

A scent strength adjustment button 40 may be provided at the right side of the temperature control button 18. The scent strength adjustment button 40 may be configured to adjust the strength of the scent with four levels whenever the user presses it, and the set scent strength may be delivered to the user through a scent strength display means 40*a*. Furthermore, a recharging lamp 40*b* for notifying that the fragrant solution is insufficient in the cartridge may be provided at an upper portion of the scent strength display means 40*a*. The recharging lamp 40*b* may emit light even when the cartridge for storing a fragrant solution is not mounted in the dryer as well as when the fragrant solution is insufficient. Of course, it may be provided with a separate lamp for notifying whether or not the cartridge is mounted therein.

On the other hand, when a liquid stored in the cartridge is recognized by the electrode sensor and then a selection disabled in the recognized liquid is made by the user, a lamp for notifying this may be provided therein. For example, in case where the user selects a course including the fragrant solution spray process when water is charged in the cartridge, the lamp may be turned on to notify that the user's selection is wrong.

Here, the scent strength adjustment button 40 may be activated only when the course selected by the knob 30 sprays a fragrant solution, but the function may not be operated when pressing the other buttons. Accordingly, it may be possible to prevent a malfunction from occurring by unnecessarily pressing the scent strength adjustment button 40, and the strength of the scent may be sequentially adjusted subsequent to the selection of a course, thereby enhancing the use convenience.

For this purpose, an LED element (not shown) may be provided at a lower portion of the scent strength adjustment button 40 to allow the user to visually recognize it when the scent strength adjustment button 40 is activated. Reference numeral 24*a* of the option buttons 24 as a drying time set button may be set to perform a drying operation only for a preset period of time through the drying time set button 24*a*.

Figure 7:
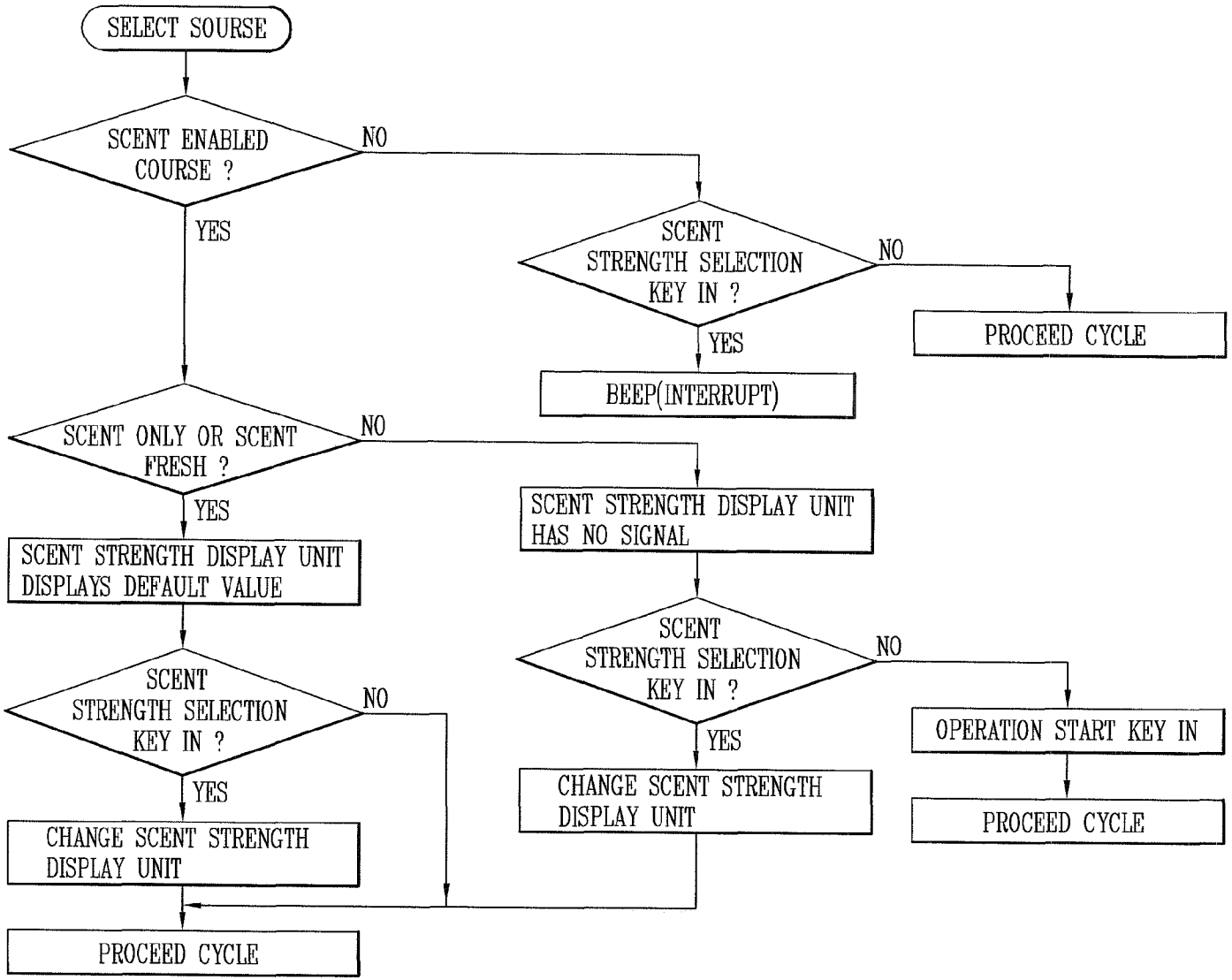
FIG. 7 is a flow chart illustrating an operation of the embodiment illustrated in FIG. 6.

Now, the operation of the foregoing operation will be described with reference to FIG. 7. First, if the user selects his or her desired course by rotating the knob 30, then the controller 107 included in the dryer checks whether or not the selected course is a scent addition enabled course, namely, whether or not the process of spraying a fragrant solution is included subsequent to drying, and activates the scent strength adjustment button 40 when it is a scent addition enabled course. If the user presses the scent strength adjustment button 40 in a state that a scent addition disabled course, namely a refresh course, is set, then a beep sound may be output to notify that it is a wrong selection, and the selected cycle may be carried out when there is no button input for a preset period of time or the operation/pause button is pressed.

Subsequently, if it is a scent addition enabled course, then the controller 107 checks whether it is an exclusive scent course. In other words, a general drying course of the courses may correspond to a course for which the user can select whether to add scent, and the scent refresh course is a basic requirement and thus it may correspond to an exclusive scent course. Accordingly, when the selected course is an exclusive scent course, the scent strength is set to a "NORMAL" level if a specific value is not entered by the user, and thus a lamp corresponding to the "NORMAL" level is turned on through the scent strength display means 40*a*. Then, if the scent strength adjustment button 40 is pressed by the user, then the cycle is carried out by changing the scent strength to be displayed based on this, and if the scent strength adjustment button 40 is not pressed for a preset period of time or the operation/pause button is pressed, then the selected cycle is carried out. If the selected course is a general drying course capable of selecting whether to add scent, then a lamp provided in the scent strength display means 40*a* is turned off, thereby allowing the user to recognize that the scent strength should be adjusted.

In this step, if the user selects nothing or presses the operation/pause button, then a cycle corresponding to a general drying course having no scent addition step may be carried out, and if the scent strength adjustment button 40 is pressed, then the scent strength display means 40*a* corresponding to the scent strength changed based on this may be turned on, and if there is no button input for a preset period of time, then the selected cycle may be carried out.

On the other hand, when the scent strength adjustment button can be selected during the process, namely, when the scent strength adjustment button 40 is activated, an LED element of the scent strength adjustment button 40 may be turned on or off, thereby allowing the user to recognize that scent is added by spraying a fragrant solution during the drying process and the strength can be adjusted. It may be also displayed by using another method. In other words, a separate LED for notifying that scent is sprayed during the drying process may be provided adjacent to the knob 30 to turn it on or off, and otherwise, LEDs may be provided for every courses, respectively, and then the form or color of lighting or the form or shape of LED arrangements may be differently configured to distinguish a scent addition course from the other courses.

In addition to the method of using LEDs, the method of varying course-printing colors adjacent to the knob 30, printing different colored bars, or outputting a specific sound may be also taken into consideration. In this case, the sound may be outputted only in case of a scent addition course, or different sounds may be outputted for a scent addition course and the other courses.

Then, the user may press the scent strength adjustment button 40 to input information on his or her desired strength of the scent, and the controller 107 may spray an amount fragrant solution corresponding to the inputted scent strength information subsequent to the completion of the drying process. In addition, buttons for allowing the user to directly select a load and a kind of clothes related to spraying a fragrant solution may be provided on the manipulation panel.

Figure 8:
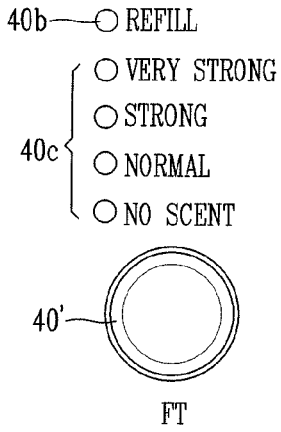
FIG. 8 is a front view illustrating another embodiment of the manipulation panel.

On the other hand, the foregoing embodiment may be modified into another form. In other words, in case of a general drying course of the courses, the user may select whether to spray scent, and a means for implementing this may be provided on the manipulation panel, and it may be implemented through the scent strength adjustment button. FIG. 8 is a view illustrating a modified example of the scent strength adjustment button, wherein the selection of the scent strength adjustment button 40' may be formed of four levels, and scent addition is not carried out at "NO SCENT" which is the lowest level. The set scent strength may be delivered to the user through a scent strength display means 40*c*. In this case, the "NO SCENT" may be activated to enable the selection only when a general drying course of the courses on the scent strength adjustment button 40' is selected. In other words, a selectable course may be divided into an exclusive scent addition course, a scent addition selectable course, and a scent addition disabled course. The scent strength adjustment button may be deactivated in case of the scent addition disabled course, and the "NO SCENT" level may be selectable in case of the scent addition selectable course, and the scent strength adjustment button may be activated but the "NO SCENT" level may be non-selectable in case of the exclusive scent addition course.

Figure 9:
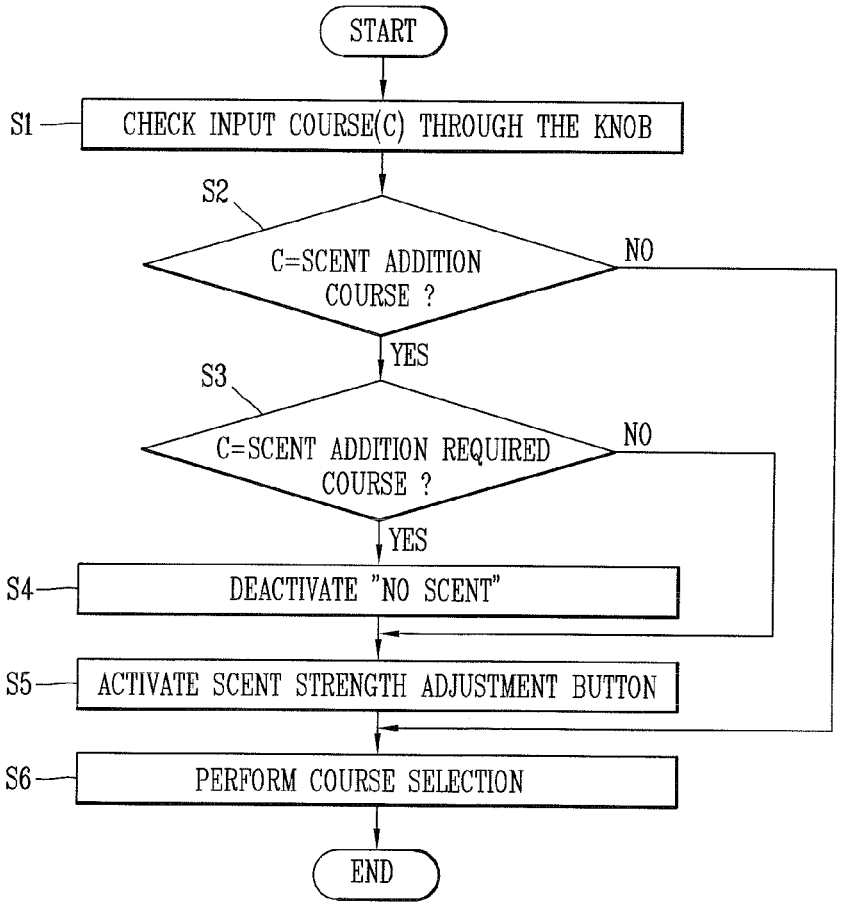
FIG. 9 is a flow chart illustrating an operation of the embodiment illustrated in FIG. 8.

The foregoing process is illustrated in FIG. 9. If the user turns on the power of the dryer and enters a course (C) through the knob 30, then the controller 107 checks the entered course in step S1. When scent addition is not enabled by checking the course (C) (step S2), the selected course may be carried out to finish the operation. However, when the scent addition enabled course is selected, the controller 107 rechecks whether the scent addition process is required (step S3).

When the scent addition process is required, namely, in case of the exclusive scent addition course, it may proceed to step S4 to deactivate "NO SCENT", thereby not allowing "NO SCENT" to be selected. In case of the scent addition selectable course, it may proceed to step S5 to allow the user to select his or her desired scent strength, and then perform the selected course based on the preset information (S6).

Figure 10:
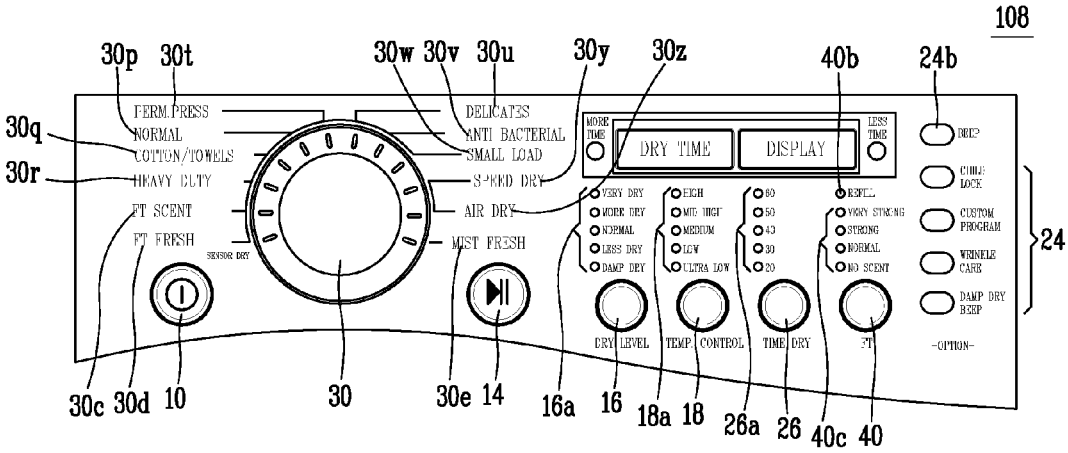
FIG. 10 is a front view illustrating still another embodiment of the manipulation panel.

FIG. 10 is a view illustrating still another embodiment of the manipulation panel 108. The same elements as the buttons illustrated in FIG. 6 are designated with the same numeral references and their redundant description will be omitted. Of the items arranged at an outer circumferential portion of the course selection knob 30, reference numeral 30*c* is the foregoing scent addition course, reference numeral 30*d* is the scent refresh course, and reference numeral 30*e* corresponds to the refresh course. Furthermore, a drying time set button 26 may be provided at the right side of the temperature control button 18, and a drying time display means 26*a* for displaying the set drying time may be disposed at an upper portion of the drying time set button 26. Moreover, a beep sound set button 24*b* for adjusting a beep sound may be provided at the side of the option button 24.

In the embodiment illustrated in FIG. 10, a scent addition course described on the knob 30 may be further added compared to FIG. 6, allowing the user to intuitively select more various kinds of drying courses. Here, the "NO SCENT" level may be activated when a general drying course is selected, thereby allowing the user to perform a course selection and option setting as the foregoing embodiment of FIG. 8 over several steps.

Figure 11:
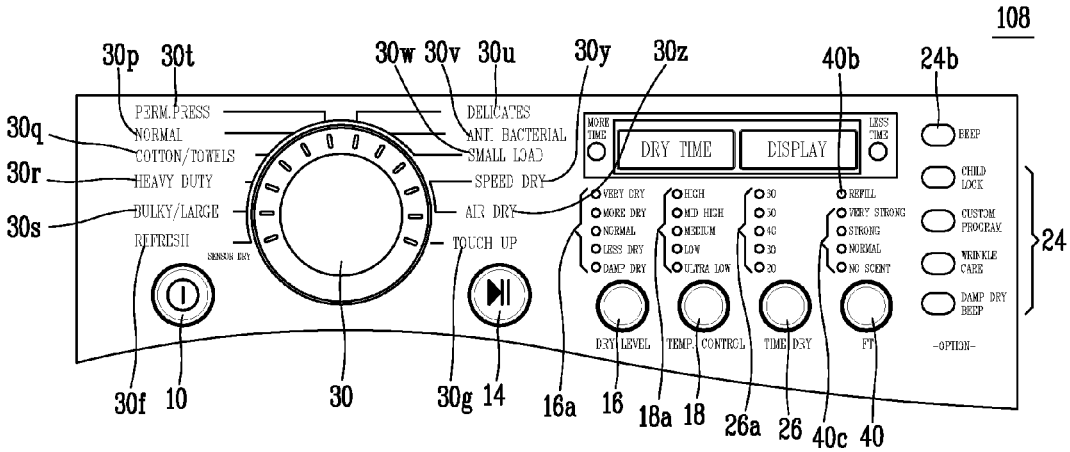
FIG. 11 is a front view illustrating still another embodiment of the manipulation panel.

FIG. 11 is a view illustrating still another embodiment of the manipulation panel 108. The same elements in FIG. 11 as the buttons illustrated in FIG. 6 or 10 are designated with the same numeral references and their redundant description will be omitted. Of the items arranged at an outer circumferential portion of the course selection knob 30, reference numeral 30*f* may be provided to select either one of the scent refresh course and refresh course, and reference numeral 30*g* may correspond to the foregoing touch-up course. Here, when the user selects the reference numeral 30*f* by rotating the knob 30, the resultant selected course may be determined by the scent strength adjustment button 40.

In other words, if the scent strength adjustment button 40 is adjusted to set to any one of "VERY STRONG", "STRONG" and "NORMAL" which display the scent strength, then the scent refresh course may be selected, and if it is adjusted to "NO SCENT", then the refresh course may be selected. As a result, the number of items arranged around the knob 30 may be smaller than that of the actually selectable courses, and thus the arrangement around the knob may be simplified to enhance visibility, thereby facilitating its selection, and options that can be set by the user at each step may be activated to inform items that should be selected by the user for each step, thereby facilitating its operation.

Figure 12:
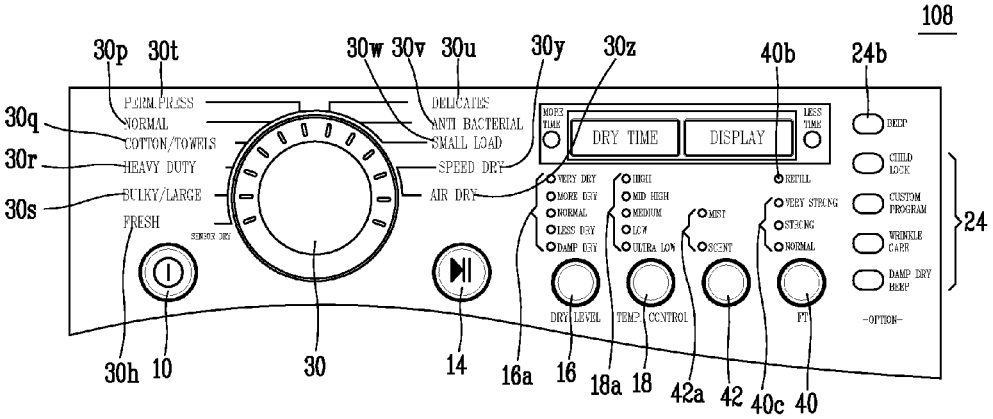
FIG. 12 is a front view illustrating still another embodiment of the manipulation panel.

FIG. 12 is a view illustrating still another embodiment of the manipulation panel 108. In FIG. 12, the scent addition course and refresh course may be grouped into a FRESH course 30*h*, and it may further include a medium selection button 42. In other words, if the user selects the FRESH course 30*h*, then the medium selection button 42 may be activated, and through this the user may select whether to add scent. If the user selects "MIST" through the medium selection button 42, then the foregoing refresh course may be carried out, and if the "SCENT" is selected, then the scent refresh course may be carried out. Of course, according to circumstances, the scent addition course may be carried out instead of the scent refresh course.

If the user selects "SCENT", then the scent strength adjustment button 40 may be activated. Here, the foregoing "NO SCENT" may not be included in the step that is selectable by the scent strength adjustment button 40. It is because the user has selected scent addition in advance, and thus if "NO SCENT" is included therein, then the scent addition may be cancelled, thereby causing a malfunction.

Figure 13:
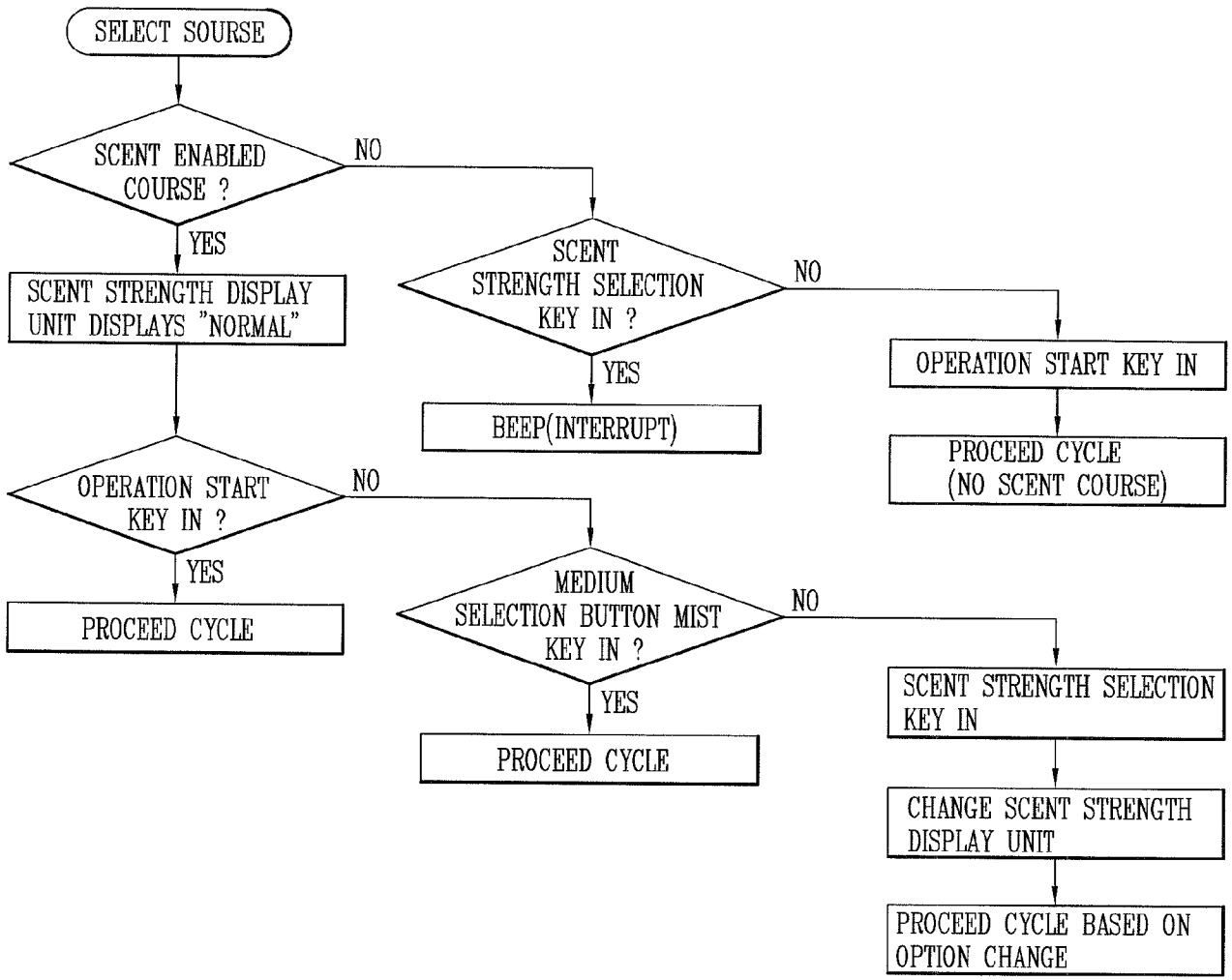
FIG. 13 is a flow chart illustrating an operation of the embodiment illustrated in FIG. 12.

The operation of the foregoing embodiment will be described with reference to FIG. 13. If a course is selected by the user, then the controller 107 checks whether the selected course is a scent addition enabled course. In case of a scent addition disabled course, the scent strength adjustment button may be deactivated, and the selected cycle may be carried out when there is no button input for a preset period of time or the operation/pause button is pressed. If the scent strength adjustment button is pressed in a state that the scent strength adjustment button is deactivated, then the controller 107 may output a beep sound to notify the user that it is a wrong selection, and wait another button input.

When the selected course is a scent addition enabled course, then the controller 107 may operate the scent addition display means to turn on the lamp corresponding to "NORMAL" which is a basically selected scent strength level. In this state, if the operation/pause button is pressed, then the selected cycle may be carried out. On the other hand, if the medium selection button is activated and the user selects "MIST" through the medium selection button in the above step, then a scent addition disabled course may be carried out. Here, for the medium selection button, "SCENT" may be set as a default value when the selected course is a scent addition enabled course. Accordingly, if the user does not select "MIST", it may be set to enable scent addition, and at the same time the scent strength adjustment button may be activated to be in a standby state for a button input. In this step, if there is no button input for a preset period of time through the scent strength adjustment button or the operation/pause button is pressed, then the cycle may be carried out and if there is an input through the scent strength adjustment button, then the corresponding scent strength may be displayed to perform the cycle.

On the other hand, when the selected course is an exclusive scent course, then the medium selection button may be deactivated. Accordingly, the controller 107 may display "NORMAL" which is a default step through the scent strength display means when the exclusive scent course is selected, and perform the cycle when there is no key input for a preset period of time or the operation/pause button is pressed, and display the changed level to perform the cycle when there is an input through the scent strength adjustment button.

On the manipulation panel 108 illustrated in FIG. 12, the medium selection button 42 and the scent strength adjustment button 40 may be integrated to provide the scent strength adjustment button 40 having the shape illustrated in FIG. 8. In this case, if the "NO SCENT" is selected by the scent strength adjustment button 40, then the refresh course may be carried out, and otherwise the scent refresh course may be carried out, thereby further simplifying the arrangement of the manipulation panel.

Figure 14:
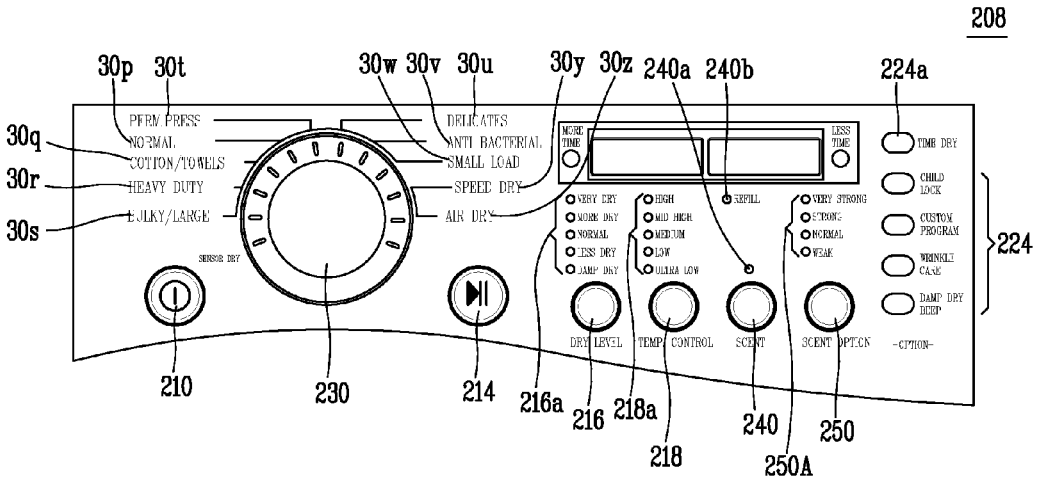
FIG. 14 is a front view illustrating still another embodiment of the manipulation panel.

Referring to FIG. 14, still another embodiment of the manipulation panel is illustrated.

In FIG. 14, a power button 210 may be provided at the left side of the manipulation panel 208 and a course selection knob 230 may be disposed at the right side of the power button 210.

The items corresponding to each course provided in the dryer may be arranged at an outer circumferential portion of the course selection knob 230, and the course provided therein may be selected by rotating the course selection knob 230 to align one of the items to a display line (not shown) of the knob 230. An operation/pause button 214 may be provided at the right side of the knob 230, and a dry level button 216, a temperature control button 218 for indicating the temperature of hot air supplied at the time of drying, and an option selection button 224 for setting various selection items, and the like may be provided at the right side thereof.

A dry level display button 216*a* for displaying a state of being set may be provided at an upper portion of the dry level button 216, wherein the dry level display button 216*a* may include a plurality of LED elements, and an element having the corresponding level of the LED elements emits light whenever pressing the dry level button 216. It may be also applicable to the temperature display means 218*a* disposed at an upper portion of the temperature control button 218.

A scent selection button 240 may be provided at the right side of the temperature control button 218. The scent selection button 240 is provided to select whether to spray a fragrant solution subsequent to performing the relevant course after a course is selected by the knob 230. Accordingly, if the user presses the scent selection button 240, then the user may be allowed to recognize that fragrant solution spray has been selected while turning on the LED 240*a* disposed at an upper portion thereof, and the controller may spray a fragrant solution subsequent to the completion of the drying process. Furthermore, if the user presses the scent selection button 240 without selecting a course, then a fragrant solution may be sprayed without performing the drying process. Moreover, a recharging lamp 240*b* for notifying that the fragrant solution is insufficient in the cartridge may be provided at an upper portion of the scent selection button 240. The recharging lamp 240*b* may emit light even when the cartridge for storing a fragrant solution is not mounted in the dryer as well as when the fragrant solution is insufficient. Of course, it may be provided with a separate lamp for notifying whether or not the cartridge is mounted therein.

On the other hand, a scent strength adjustment button 250 may be provided adjacent to the scent selection button 240. The scent strength adjustment button 250 may be configured to adjust the strength of the scent with four levels whenever the user presses it, and the set scent strength may be delivered to the user through a scent strength display means 250*a*.

Here, the scent strength adjustment button 250 may be activated only when it is set by the scent selection button 240 to spray a fragrant solution, but the function may not be operated when pressing the other buttons. Accordingly, it may be possible to prevent a malfunction from occurring by unnecessarily pressing the scent strength adjustment button 250, and the strength of the scent may be sequentially adjusted subsequent to the selection of spraying a fragrant solution, thereby enhancing the use convenience.

For this purpose, an LED element (not shown) may be provided at a lower portion of the scent strength adjustment button 250 to allow the user to visually recognize it when the scent strength adjustment button 250 is activated. Reference numeral 224*a* of the option buttons 224 as a drying time set button may be set to perform a drying operation only for a preset period of time through the drying time set button 224*a*.

On the other hand, in addition to the scent strength adjustment button 250 illustrated in FIG. 14, various kinds of detailed items setting means may be provided thereon. For example, a laundry quantity input button or laundry quality input button may be additionally provided adjacent to the scent strength adjustment button, and through this the user may set an amount of drying objects, a kind of clothes, and the like, and the controller may determine an optimal amount of fragrant solution spray based on the inputted information.

Figure 15:
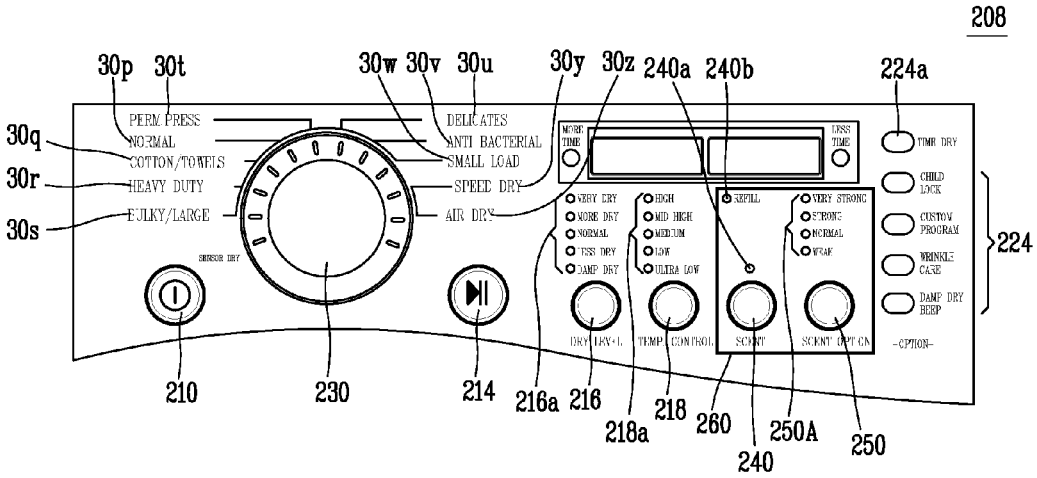
FIG. 15 is a view illustrating still another example of the manipulation means of FIG. 14.

FIG. 15 is a view illustrating still another example of the manipulation means of FIG. 14, wherein a rectangular-shaped pattern 260 may be printed or attached around the scent strength adjustment button 250. Through this, the user may recognize that two buttons located inside the pattern 260 are functionally associated with each other, thereby further facilitating the manipulation of the apparatus. If the foregoing laundry quantity input button or laundry quality input button are additionally provided thereon, then all they may be located inside one pattern.

Figure 16:
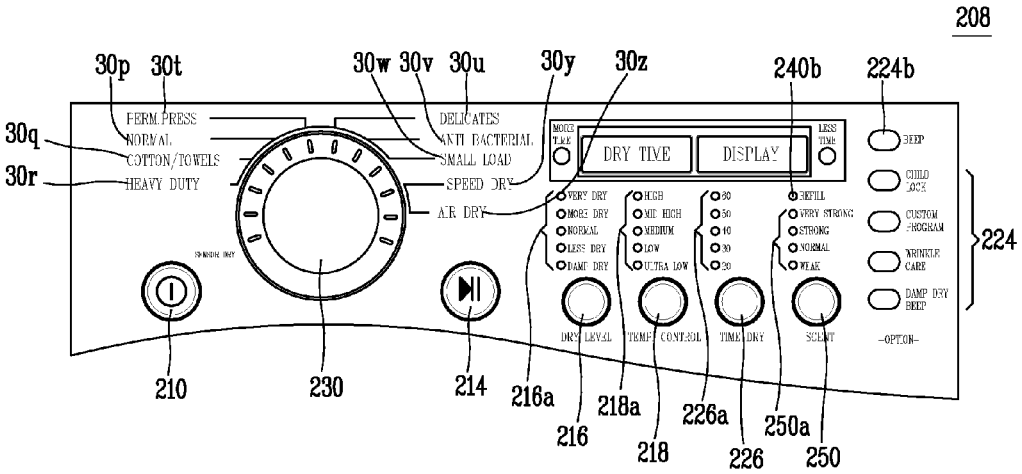
FIG. 16 is a view illustrating still another example of the manipulation means of FIG. 14.

FIG. 16 is a view illustrating still another example of the manipulation means of FIG. 14, wherein the scent selection button and scent strength adjustment button may be integrated into one button. In FIG. 16, reference numeral 224*b* may be a beep sound set button for setting or releasing various alarm sound outputs, and reference numeral 226 may be a drying time set button, and reference numeral 226*a* may be a display means for displaying a set dry time. The drying time set button may be set to perform a drying operation only for a preset period of time through the drying time set button 226. In the example illustrated in FIG. 16, the set scent strength may be displayed with four levels on the LED 250*a* provided at an upper portion of the scent strength adjustment button 250. However, in the embodiment illustrated in FIG. 16, a general drying course may be carried out when the user selects a course through the knob 230 and then presses an operation button 214 without manipulating the scent strength adjustment button 250, and a fragrant solution may be sprayed subsequent to performing the drying course when the user selects a course and then enters a scent strength to be sprayed through the scent strength adjustment button 250.

Even in the example illustrated in FIG. 16, the foregoing laundry quantity and laundry quality buttons may be of course provided thereon.

The invention claimed is:

1. A laundry treating apparatus having a plurality of laundry treating courses with different laundry treating methods, the apparatus comprising:

a drum configured to accommodate the laundry;

a hot air supply means configured to supply hot air to an inner side of the drum, the hot air supply means comprising:

a suction duct configured to transfer air to the drum, and a heater provided in the suction duct and configured to heat the air;

a nozzle configured to spray a fragrant solution into an inner portion of the drum;

a manipulating panel comprising a course selection means configured to select the laundry treating courses and a scent spraying cancellation button; and a controller configured to control the apparatus according to an instruction inputted by the manipulating panel, wherein the plurality of laundry treating courses comprises scent spray courses for spraying the fragrant solution during the laundry treating process, wherein the course selection means comprises a scent spray course selection means for selecting one of the scent spray courses, wherein the controller is configured to control such that a fragrant solution spraying process is not carried out while performing a laundry treating course selected by the course selection means when the scent spraying cancellation button is selected, and wherein the scent spraying cancellation button is deactivated when a course selected by the course selection means does not include a scent spraying process.

2. The apparatus of claim 1, wherein the manipulating panel further comprises a scent strength adjustment button, and the controller controls such that the scent strength is adjusted according to a scent strength selected by the scent strength adjustment button.

3. The apparatus of claim 2, wherein the scent strength adjustment button is deactivated when a course selected by the course selection means does not include a scent spraying process.

4. The apparatus of claim 1, wherein at least some of the scent spray courses have different scent spray timings.

5. The apparatus of claim 4, wherein the manipulating panel further comprises a scent strength adjustment button, and the controller controls such that the scent strength is adjusted according to a scent strength selected by the scent strength adjustment button.

6. The apparatus of claim 5, wherein the scent strength adjustment button is deactivated when a course selected by the course selection means does not include a scent spraying process.

* * * * *